United States Patent [19]

Clark

[11] 4,151,676

[45] May 1, 1979

[54] TOY WITH ROLLING MEANS FOR MOVEMENT DOWN AN INCLINE

[75] Inventor: William F. Clark, London, England

[73] Assignee: Lesney Products Company Limited, London, England

[21] Appl. No.: 784,601

[22] Filed: Apr. 4, 1977

[30] Foreign Application Priority Data

Apr. 13, 1976 [GB] United Kingdom ..... 15147/76

[51] Int. Cl.[2] ..... A63H 13/18

[52] U.S. Cl. ..... 46/147; 46/129; 46/149

[58] Field of Search ..... 46/149, 129, 147, 134, 46/1 C; 273/86 E

[56] References Cited

U.S. PATENT DOCUMENTS

| | | | |
|---|---|---|---|
| 1,332,072 | 2/1920 | Shaw | 46/149 |
| 1,421,694 | 7/1922 | Juergens | 46/149 |
| 2,179,084 | 1/1939 | Cook | 273/86 E |
| 2,583,061 | 1/1952 | Reed | 46/147 |

FOREIGN PATENT DOCUMENTS

| | | | |
|---|---|---|---|
| 228239 | 11/1910 | Fed. Rep. of Germany | 46/129 |
| 233177 | 4/1911 | Fed. Rep. of Germany | 46/149 |

*Primary Examiner*—F. Barry Shay

*Attorney, Agent, or Firm*—Browdy and Neimark

[57] ABSTRACT

A toy moves downwardly along an incline under the action of gravity in a manner simulating a walking, shuffling, swinging or like motion. The toy is of pendular configuration, having a portion arranged to make rocking contact with a suitably disposed grade, rail or the like affording the incline, and having at least one ball, roller, or wheel which projects displaceably from that portion in such a way that, upon displacement of the or each ball, roller, or wheel, relative thereto, the position of the center of gravity of the whole toy, with respect to the incline, will be altered. The toy may be in the form of a skier and may have sufficient momentum to push obstructions from its path, open gates, etc, or to pick up an object in transit, by means of hooks, magnets, and the like.

10 Claims, 5 Drawing Figures

TOY WITH ROLLING MEANS FOR MOVEMENT DOWN AN INCLINE

This invention relates to toys and one of its objects is to provide a gravity-operated walking or shuffling toy which is an improvement over known toys of that kind.

Walking or shuffling toys are known which, when placed on a flat surface that is inclined to the horizontal, will move downwardly over that surface with a more or less rolling gait. Such known toys often represent two human or animal figures arranged one behind the other and usually suffer from one or more of the following disadvantages. The inclination of the surface over which the toy is to move to the horizontal can only vary marginally from an optimum value if the toy is to walk or shuffle as intended without jamming, falling over or otherwise failing to function correctly. The surface must be very smooth since any significant undulation therein will cause the toy to stick or fall over or to deflect from a substantially straight line to such an extent that it subsequently requires manipulation before it will recommence its downward progress. In fact, the known toys will only make progress in a substantially straight line and almost any obstacle to such progress will stop one of them. The known toys almost always have to be "started" by hand before gravity alone will move them to the bottom of suitably disposed sloping surfaces.

According to the invention, there is provided a toy which will move downwardly along an incline under the action of gravity in a manner simulating walking, shuffling, swinging or like motion, wherein the toy has a portion arranged to make rocking contact with a suitably disposed incline, and means in the form of at least one ball, roller or wheel, which projects displaceably from said portion in such a way that, upon displacement of said means relative to the portion, the position of the center of gravity of the whole toy, with respect to the incline will be altered.

Figure 1:
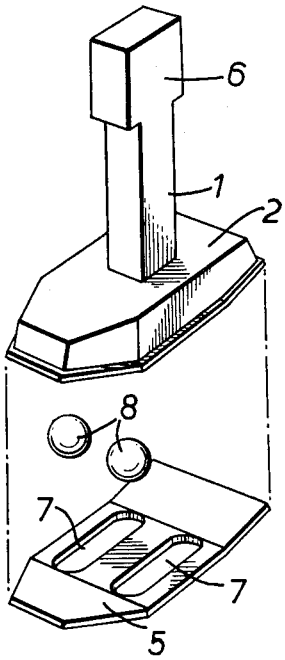
Figure 2:
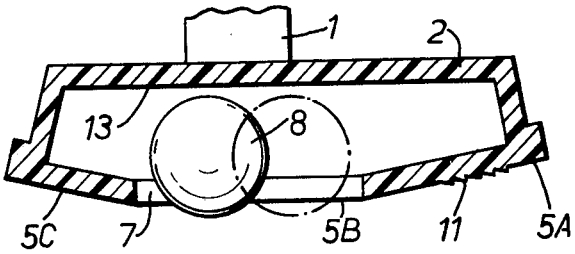
Figure 3:
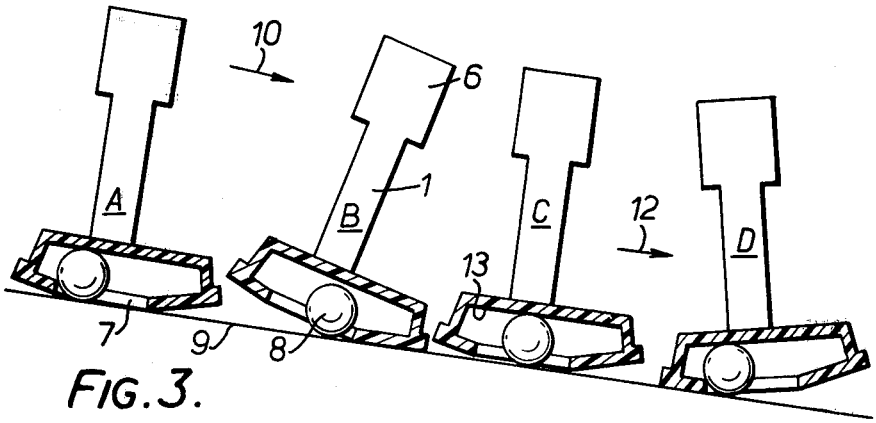
Figure 4:
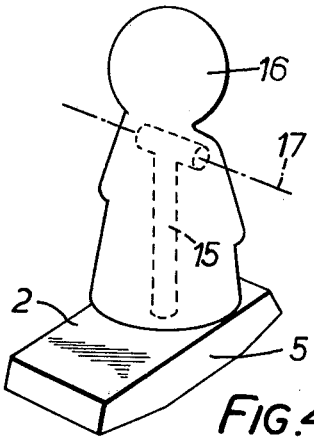
Figure 5:
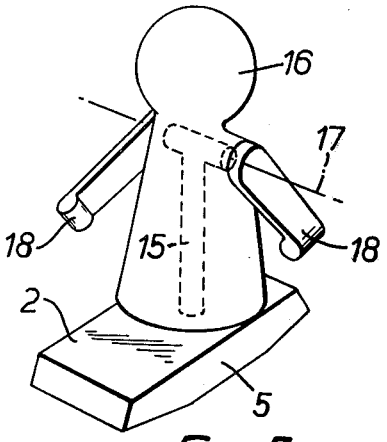
Figure 6:
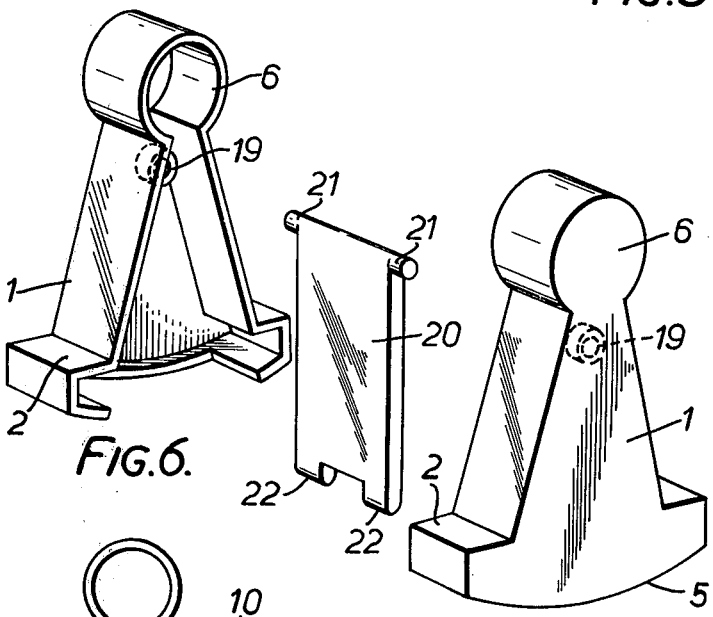
Figure 7:
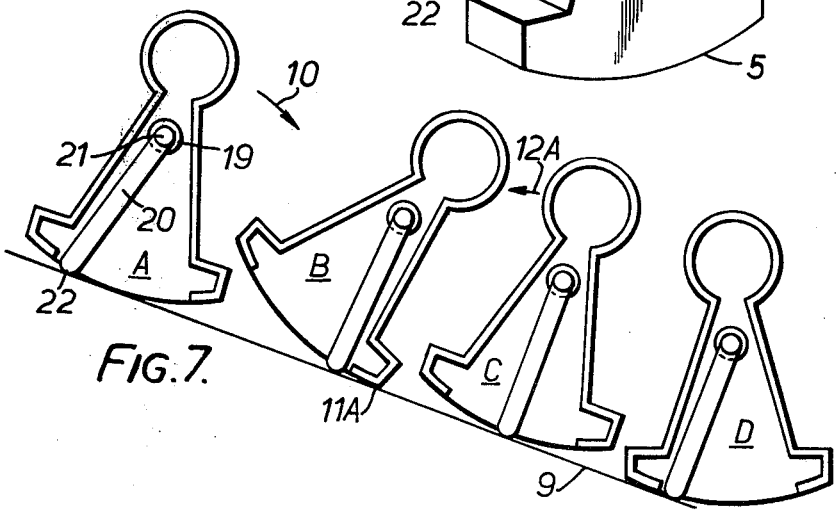

For a better understanding of the invention, and to show how the same may be carried into effect, reference will now be made, by way of example, to the accompanying drawings, in which:

FIG. 1 is an exploded perspective view of a basic form of toy in accordance with the invention, FIG. 2 is a sectional elevation, to an enlarged scale, of the base of the toy of FIG. 1 in an assembled condition, FIG. 3 is a side elevation illustrating four stages in the progress down an inclined surface of a toy similar to that of FIGS. 1 and 2, FIG. 4 is a perspective view diagrammatically illustrating a walking or shuffling toy constructed in accordance with the invention, and FIG. 5 is a similar view to FIG. 4 but illustrates a toy figure provided with swinging arms.

Referring firstly to FIGS. 1 to 3 of the drawings, the toy that is somewhat diagrammatically illustrated therein comprises an upright inverted pendular body 1 integrally or fixedly mounted on a platform 2. When an initially separate construction is employed the platform 2 is fixed to the body 1 by ultrasonic welding or in any convenient known manner. The lower surface of a base portion or base 5 of the platform 2 is in the form of three successively inclined substantially planar faces 5A, 5B and 5C (FIG. 2), all three of said faces being tangential to an imaginary cylindrically curved surface whose axis of curvature is, when the toy is assembled, substantially coincident with the center of an enlargement or head 6 at the top of the body 1. The central face 5B of the base 5 is formed with two slots 7 that are in regularly spaced apart relationship, said slots 7 extending generally fore and aft of the toy and being arranged to receive corresponding balls 8 of metal or other relatively heavy material in such a way that said balls 8 are movable along the slots 7 beneath the platform 2 with small regions thereof projecting downwardly through the slots 7 and beyond the central face 5B of the base 5. When the toy is assembled, the overlying bottom surface of the platform 2 prevents the balls 8 from getting out of the slots 7 between the base 5 and the platform 2.

Referring particularly to FIGS. 2 and 3 of the drawings, the toy of FIG. 1 is shown even more diagrammatically in FIG. 3 at four stages of progress down an inclined flat surface 9. In the illustrated starting position which is denoted by the reference A, the enlargement or head 6 at the top of the body 1 will tend to tilt forwardly in the direction of an arrow 10 about the junction between the faces 5A and 5B until a position approximately equivalent to the illustrated second position B is reached. When the second position B is reached, the balls 8 will be free to fall to substantially the leading ends of the slots 7 with respect to the downhill direction and a roughened braking area 11 (FIG. 2) on the face 5A will have come into braking contact with the slope 9. Subsequently, the toy will tend to rock back in a direction opposite to the arrow 10 whilst simultaneously rolling further down the slope 9 in the direction of an arrow 12 as the balls 8 make rolling contact with tracks 13 that are formed at the bottom of the platform 2 in vertical register with the corresponding underlying slots 7. This position of the toy is designated C in FIG. 3 and rearward rocking of the body 1 continues opposite to the direction 10 until substantially a position corresponding to that indicated by the reference D is reached. In the position D, the unroughened face 5C of the base 5 that is located immediately beyond the rearmost ends of the slots 7 comes into braking contact with the flat sloping surface 9 and the cycle then recommences with the body 1 rocking forwardly in the direction 10 about the junction between the faces 5B and 5C so that the toy very soon again assumes the starting position A.

In the position A, the center of gravity of the whole toy is in advance, down the sloping surface 9, of the points of contact between the balls 8 and that surface 9 but, by the time that the second position B has been reached, the center of gravity of the whole toy is substantially behind the face 5A which is then in contact with the slope 9. As the body 1 rocks back opposite to the direction 10 and the position of that body changes relative to the balls 8 because of the rolling motion of those balls along the corresponding tracks 13, the relative position of the center of gravity of the whole toy is again altered until, by the time that the position D is reached, said center of gravity is again disposed forwardly of the points of contact of the balls 8 with the slope 9 with respect to the downward direction of progress 12 of the toy over said slope 9. The balls 8 afford means which projects displaceably from the base 5 of the toy in such a way that, upon displacement thereof relative to the base 5, the position of the center of gravity of the whole toy, with respect to the incline, is altered and this arrangement is a principal factor in improving toys in accordance with the invention as compared with known walking or shuffling toys as will be further discussed below.

FIG. 4 of the drawings illustrates a toy in accordance with the invention whose base 5 may be formed in the manner that has already been described with reference to FIGS. 1 and 2 of the drawings thus incorporating the slots 7 in the face 5B and the balls 8 which project downwardly therethrough. In the embodiment of FIG. 4, a generally T-shaped upright 15 projects upwardly from a substantially central region of the platform 2, the crossbar of the "T" being horizontally disposed at the top of the upright 15 in substantially parallel relationship with the central axis of curvature of the imaginary cylindrically curved surface to which the faces 5A, 5B and 5C of the base 5 are tangential. A swingable body 16 that is, effectively, of inverted pendular formation, is pivotally mounted on the crossbar of the T-shaped upright 15 so as to be freely angularly displaceable through a few degrees about the longitudinal axis 17 of said crossbar. The body 16 may simulate a human or animal figure and the fact that said body will swing to and fro about the axis 17 during progress of the toy down a slope (in substantially the manner that has been described with particular reference to FIG. 3 of the drawings) adds to the interest value of the toy.

FIG. 5 of the drawings illustrates a further toy in accordance with the invention which toy is very similar to the toy that has already been described with reference to FIG. 4. However, in the embodiment of FIG. 5, the swingable body 16 is additionally provided with swingable arms 18, said arms 18 being swingable about the axis 17 relative to the upright 15 independently of the body 16 itself. Thus, when the toy is in use, its arms 18 will appear to swing relative to the body 16 as said toy makes walking or shuffling progress down a suitably inclined sloping surface such as the slope 9 illustrated in FIG. 3.

The balls 8 are not the only means that can be employed to project displaceably from the base 5 of a toy in accordance with the invention. For example, cylindrical rollers or disc-shaped wheels could be substituted for the balls 8 although the use of the balls 8 does have the advantage that the toy will more readily swivel on one of the balls 8 to change its direction of motion as will be discussed further below. Generally speaking, the body 1, platform 2 and base 5 can conveniently be made from synthetic plastics materials whilst the balls 8 may advantageously, but not essentially, be formed from metals to give them more weight per unit volume than the parts of the toy that are made from synthetic plastics materials. Many different forms of body 1 are possible such as the swingable body 16 of the embodiment of FIGS. 4 and 5 of the drawings. Other possibilities include a body simulating a pecking chicken, a body simulating a mounted horseman and bodies simulating single human, animal or mythical figures or pairs or groups of such human, animal or mythical figures. Many action features can be incorporated such, for example, as the swingable body 16 and swingable arms 18 of the embodiment of FIG. 5 of the drawings. Other possibilities include movable weapons such as axes, lances, swords and the like, bells, rattles and other sound producing items. It is possible to produce a platform and base assembly provided with displaceable balls, rollers, wheels or the like to which assembly any chosen one of a number of different bodies can be releasably attached by such means as synthetic plastics "poppers", press studs or the like.

As discussed at the beginning of this Specification, walking or shuffling toys are already well known that will proceed in substantially only a straight line down inclined surfaces with a somewhat side-to-side rolling gait. A toy in accordance with the invention tends to shuffle forwardly with a fore and aft pendular rocking motion and avoids, or at least significantly reduces, the disadvantages of operation of the known toys that are discussed above. A toy in accordance with the invention does not require as critical an inclination of the surface with which it is to co-operate to the horizontal before it will walk/shuffle. Obviously, a toy in accordance with the invention will not operate on a very nearly horizontal surface nor one that is very steeply inclined to the horizontal but the range of inclination to the horizontal on which it will work effectively is significantly greater than with known walking or shuffling toys. This can be a considerable advantage when the toys are to be used by young children who are not able to appreciate the need for a precise inclination to the horizontal. The simple or compound sloping surface that is required to cooperate with a toy in accordance with the invention does not essentially have to be very smooth. A toy of the kind that has been described and illustrated will operate on a surface having discontinuities and undulations and, upon meeting, for example, an upward projection from such a surface, it will deflect its line of travel to avoid the projecting obstacle. This feature is particularly noticeable in embodiments in which the balls 8 are used. A minor obstruction will not often prevent a toy in accordance with the invention from proceeding, because the balls 8 are not closely restricted between the slots 7 and the overlying tracks 13. Thus, when one of the balls 8 meets a slight upward undulation, it can retract upwardly into its cooperating slot 7 and ride over that undulation.

In fact a toy constructed in accordance with the invention will even follow a more or less zig-zag or more or less curved course down a suitably inclined and only approximately smooth surface. The course could be predetermined by the provision of at least one side rail or by a guide slot or by the use of a compound angled track incorporating, for example, surfaces in shallow V-shaped relationship. In a plaything incorporating a toy in accordance with the invention, the surface could represent a ski slope and the toy figure be shaped to simulate a skier with a representation of a pair of skis incorporated in the base 5 and/or platform 2. A toy in accordance with the invention has sufficient momentum, on a suitably inclined surface, to allow it to push loose obstructions out of its path of movement and will open gates and perform like simple operations that merely involve the transfer of some of its surplus kinetic energy to other articles. A suitably shaped and guided toy can be arranged to pick up an object which it passes by the co-operation of hooks and rings or magnets. The object could, for example, be a simulated mailbag to be picked up by a toy representing a locomotive and mail-van. A toy in accordance with the invention may simulate a wheeled vehicle in which case the shuffling progress of the toy down a slope can be employed to vibrate the engine of the vehicle or to maintain other parts in motion relative to the body of the vehicle whilst the toy is in use. When following a predetermined track that is supplied for use with the toy, the track will normally be textured to prevent the toy slipping relative thereto and the base of the toy will also be formed with a view to the minimization of slippage. However, if considered necessary, regions of the track where the toy has to negotiate relatively difficult bends, changes of inclination and/or where it has to pick up or otherwise entrain a relatively heavy weight could be made smooth with a view to allowing some slipping to take place at such points. In very many cases, a toy in accordance with the invention is "self-starting", that is to say, it will immediately commence motion down a suitably disposed surface upon being placed thereon. Most known walking or shuffling toys have to be started by hand before they will operate satisfactorily.

In the embodiments of FIGS. 1 to 5 of the drawings, the gait which a toy will adopt down a predetermined slope can be preordained by suitably shaping the toy. For example, a slower somewhat rolling gait or faster pecking gait can be achieved by a general raising or lowering of the center of gravity of the whole toy and by changing the inclinations 23 and 24 (FIG. 2) of the leading and rear faces 5A and 5C of the base 5 to the central face 5B thereof. Generally speaking, the slots 7 are made longer in their fore and aft direction than is strictly necessary for the toy concerned to follow a path of predetermined inclination to the horizontal. This is desirable if the toy is to be able, as discussed above, to carry a weight (for example, a simulated sword) in any one of a number of different positions and/or is to move an obstruction, operate a bell or the like on a moderately steep slope. The balls 8 automatically find their own pivot points in the slots 7 and the excess length of those slots allows correct pivot points to be attained when the center of gravity of the toy is temporarily displaced by the addition of a weight in any one of several different positions.

The embodiments that have so far been described all involve a toy in accordance with the invention moving downwardly over a suitably inclined underlying surface. This is not, however, essential and the surface could be afforded by a suitably inclined profiled rail incorporating means for the suspension of a toy therefrom. The "base" portion 5 of the toy would then be uppermost and make rocking contact with the rail, the toy being of generally upright, rather than inverted, pendular configuration. A toy of this kind could, for example, simulate a monkey or a "Tarzan" figure and it will be realized that, with such a construction, a single ball 8, or equivalent roller or wheel, would often suffice.

I claim:

1. A toy which will move downwardly along an incline under the action of gravity in a manner simulating walking, shuffling, swinging or like motion, comprising:

a portion having a surface arranged to make rocking contact with a suitably disposed incline, said surface having means in the form of a textured area at least at the leading part thereof, in a downhill direction, to minimize slippage relative to such incline; and rolling means, in the form of at least one ball, roller or wheel, which is mounted in and projects displaceably from said portion in such a way that said rolling means may move along the line of said rocking contact either independently of the remainder of the toy or while supporting the remainder of the toy, whereby, upon displacement of said rolling means relative to said portion and along said line, the position of the center of gravity of the whole toy, with respect to the incline, will be altered.

2. A toy according to claim 1, wherein the toy is of inverted pendular configuration and said portion is the base of the toy.

3. A toy according to claim 1, wherein the means which projects displaceably from said portion is formed from a material that is heavy relative to the material from which at least the greater part of the remainder of the toy is formed.

4. A toy according to claim 1, wherein the toy comprises a body that is swingable, within limits, about an axis relative to said portion.

5. A toy according to claim 4, wherein the swingable body is provided with swingable arms, said arms being swingable about said axis relative to said portion independently of the body itself.

6. A toy according to claim 1, wherein said ball, roller or wheel projects through a slot defined in said surface, the slot extending fore and aft with respect to the intended direction of straight motion of the toy.

7. A toy according to claim 6, wherein the surface that is arranged to make rocking contact with a suitably disposed incline comprises three successively inclined substantially planar faces and the slot is formed in the center one of said three successively inclined substantially planar faces.

8. A toy according to claim 6, wherein said ball, roller or wheel is arranged in the slot in such a way as to be movable inwardly of that slot as well as to be displaceable therealong.

9. A toy according to claim 1, wherein the surface that is arranged to make rocking contact with a suitably disposed incline comprises three successively inclined substantially planar faces.

10. A toy according to claim 9, wherein said faces are tangential to an imaginary cylindrically curved surface whose axis of curvature is substantially coincident with the center of an enlargement of the toy that is remote from said portion.

* * * * *